United States Patent [19]

Wüllenweber et al.

[11] Patent Number: 5,013,418

[45] Date of Patent: May 7, 1991

[54] ELECTROLYZER

[75] Inventors: Heinz Wüllenweber, Frankfurt am Main, Fed. Rep. of Germany; Jürgen Borchardt, Troistorrents, Switzerland

[73] Assignee: Metallgesellschaft Aktiengesellschaft, Frankfurt am Main, Fed. Rep. of Germany

[21] Appl. No.: 346,060

[22] Filed: May 2, 1989

[30] Foreign Application Priority Data

May 5, 1988 [DE] Fed. Rep. of Germany ..... 3815266

[51] Int. Cl.[5] ..... C25B 9/00; C25B 11/03; C25B 13/04

[52] U.S. Cl. ..... 204/253; 204/283; 204/284; 204/279; 204/295

[58] Field of Search ..... 204/252–258, 204/279, 283, 295

[56] References Cited

U.S. PATENT DOCUMENTS 3,975,255 8/1976 Kircher ..... 204/279 X
4,013,537 3/1977 White ..... 204/256
4,560,461 12/1985 Okazaki et al. ..... 204/283 X
4,568,439 2/1986 Sobieniak ..... 204/279 X
4,732,660 3/1988 Plowman ..... 204/279 X

FOREIGN PATENT DOCUMENTS 1080919 8/1967 United Kingdom ..... 204/254

*Primary Examiner*—Donald R. Valentine
*Attorney, Agent, or Firm*—Sprung Horn Kramer & Woods

[57] ABSTRACT

In an electrolyzer comprising individual cells which are geometrically arranged one behind the other and consist each of two metallic partitions disposed between the cell and the adjacent cells, a diaphragm disposed between the partitions, and apertured electrodes which are mounted on both sides of and spaced from the diaphragm, a protection against short circuits and corrosion is afforded in that spacers consisting of a non-metallic high-melting hard material and firmly joined to the electrodes have been inserted into the space that is defined by the electrode and the diaphragm.

8 Claims, 1 Drawing Sheet

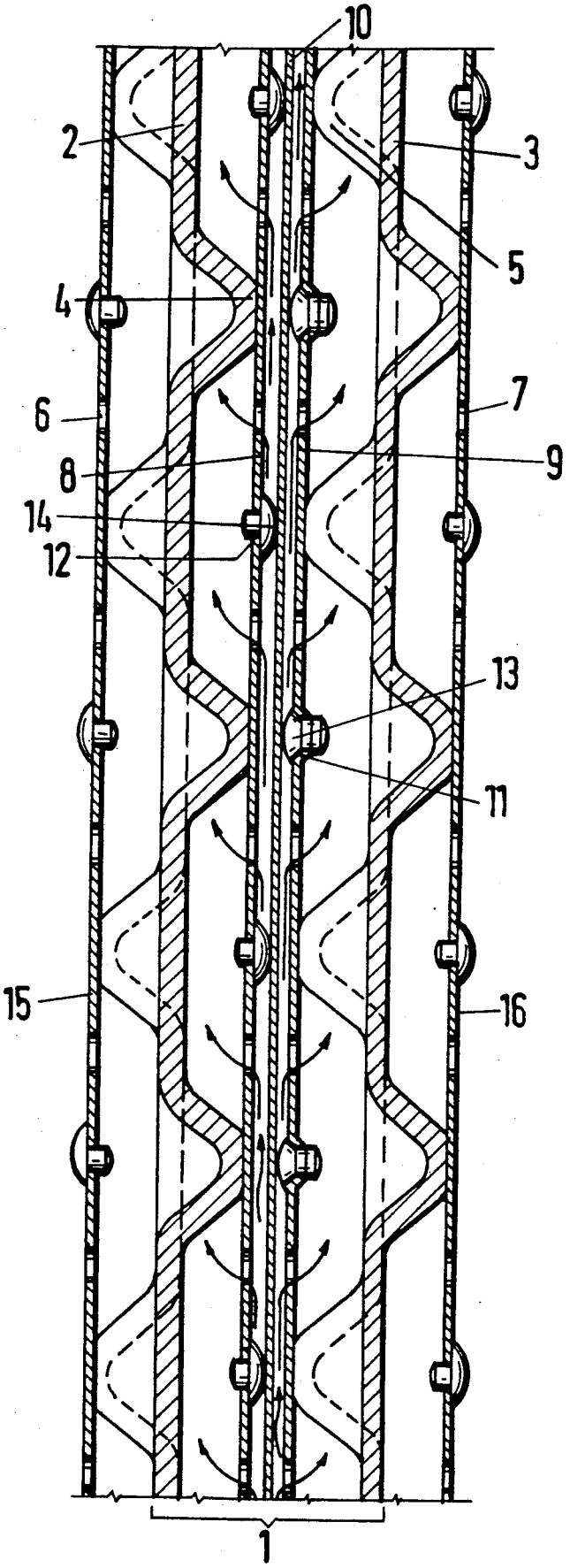
10
2
3
5
4
7
6
9
8
14
12
13
11
15
16
1

ELECTROLYZER

BACKGROUND OF THE INVENTION

This invention relates to an electrolyzer comprising individual cells which are geometrically arranged one behind the other and consist each of two metallic partitions disposed between the cell and the adjacent cells, which partitions are provided with profiled spacing means on both sides, a diaphragm disposed between the partitions, and apertured electrodes which are mounted on both sides of and spaced from the diaphragm and are joined to and in contact with the profiled spacing means disposed on that side of the associated partition which faces the diaphragm.

Commercially offered electrolyzers comprise a plurality of individual cells, each of which comprises a pair of electrodes, each of which is separated from the adjacent cell by an embossed, preferably goffered, entirely nickel-plated, metallic sheet metal partition and which are separated by a platelike diaphragm. Said cells are electrically and geometrically arranged one behind the other. The partitions are inserted in an annular metallic frame. Each metallic partition is provided on its anode and cathode sides with an electrode consisting of a woven wire mesh of nickel-plated and activated steel or a woven wire mesh consisting entirely of nickel and said electrode is forced by the other electrode against the humps of the goffered partition. A diaphragm consisting of an asbestos plate has been inserted into the space that is defined between the electrodes. Each partition is bipolar because it carries a cathode on one side and an anode on the other side. The gases evolved at each electrode rise in the space between the electrode and the partition and are conducted away from there (Lurgi-Schnellinformation D 1073, November 1981 "Wasserstoff aus Wasser", self-published in Frankfurt, 1981).

That design of a cell has given rise to the suggestion to press electrodes provided with numerous outwardly flaring conical apertures onto both sides of the diaphragm because it was assumed that any decrease of the distance between the electrodes will reduce the internal cell resistance of the electrolyzer and will thus minimize the loss of energy involved in the transportation of the current between the electrodes (Winter Z. J. and J. Nitsch: Wasserstoff als Energieträger, Springer-Verlag Berlin-Heidelberg-New York-Tokio 1986, pages 180/181). A major part of the gases will be evolved only on the side that is remote from the diaphragm because the side which faces the diaphragm is electrically substantially insulated by a thin gas film between the diaphragm and the electrode and will not contribute to the production of gas. As a result, the lines of current flow extend through the apertures of the electrode to the rear side thereof. Owing to the number of apertures which are required for that purpose, the effective electrode surface area is reduced by 20 to 30%, the lines of current flow are unnecessarily long and the equalization of the concentration of the electrolyte consisting, e.g., of 25% potassium hydroxide solution in the diaphragm is restricted because the exchange of electrolyte is restrained. The energy loss may be so high that it will entirely compensate the energy gain that can be achieved because the electrodes are arranged without a clearance. Besides, the provision of electrodes arranged without a clearance usually involves the use of a diaphragm having a thickness of 0.2 mm not in excess of 0.5 mm and involves the risk of a local corrosion and/or an overheating resulting in a risk that the diaphragm may be destroyed so that the electrodes of a cell may be short-circuited. This may result in a melting of the metallic parts of the cell so that an entire series of cells may break down.

Such local short circuits may be initiated, inter alia, by small metallic particles, which have inadvertently been enclosed between and an electrode and a diaphragm and forced into the latter during the assembling of the cells. Small errors in the manufacture of the diaphragms and/or electrodes may also result in a local corrosion, in a destruction of the diaphragm, and in a short circuit between the electrodes.

French Patent Specification 2,460,341 discloses nets which consist of insulating material and are provided as spacers between electrodes and the metallic diaphragm to effect an electrical insulation as is called for by the object. Such nets will undesirably obstruct the flow of the mixture of electrolyte and gas bubbles and the exchange of electrolyte.

The problems described hereinbefore will also arise with cells in which the electrodes are spaced a comparatively very small distance of 0.1 to 0.2 mm from the diaphragm by so-called "microspacers", which are interposed. (International Journal of Hydrogen Energy, Vol. 13, No. 3, Pergamon Press, Oxford 1988, pages 148/149).

For this reason it is an object of the present invention so to design the electrolyzer cell which has been described hereinbefore that a high safety against short circuits and corrosion will be ensured and that the energy consumption will be as high as or lower than in a clearanceless electrode assembly.

SUMMARY OF THE INVENTION

That object is accomplished in that spacers consisting of a non-metallic, high-melting hard material and firmly joined to the electrodes have been inserted into the space that is defined by the electrode and the diaphragm.

In a preferred embodiment of the invention the space defined by the electrode and the diaphragm has a width of at least 0.3 to 3.0 mm.

Consisting particularly of ceramic oxide materials, such as aluminum oxide, nickel oxide and zirconium oxide, the spacers will retain their shape in case of a short circuit in spite of extremely high temperatures, which may be as high as the melting temperature of the electrode. In case of a deformation of the electrode and/or the metallic partitions the spacers will still act as spacers so that the short circuit cannot spread.

In order to reliably eliminate the risk of a short circuit, it is another important feature of the invention that each of the spacers which are fixedly joined to each electrode or registers with those humps of the profiled spacing means which carry the other electrode.

It has been found that it will be particularly desirable to provide electrodes having a thickness of 0.15 to 0.40 mm and diaphragms having a thickness of 0.15 to 1.0 mm.

Independently of the above, the spacers in cooperation with the spring-elastic electrode exactly hold the diaphragm in position so that fluttering motions, which would result in a destruction of the diaphragm on a long run, will be inhibited and the life of the diaphragm is thus increased.

With a view to the desired result and to a long-term use, a diaphragm consisting of a thin nickel net as a carrying structure and of layers of porous ceramic oxide materials, such as nickel oxide, which have been sinter-bonded to said structure, has proved satisfactory. Alternatively, a plastic sheet may be used as a diaphragm.

It has been found that it is particularly desirable to use electrodes which consist a carrier layer of nickel and is provided on the diaphragm side with a skeleton structure made of nickel material included catalyst material consisting of the insoluble component of the Raney alloy, which skeleton structure has been formed by a cold roll cladding of a powder mixture of carbonyl nickel powder and Raney alloy powder and by sintering and a subsequent catalytic activation.

An optimum matching of the several elements of each cell will be achieved if the metallic partitions are constituted by goffered plates, which are coextensively arranged one behind the other, and the spacers of each electrode have been inserted to register with the humps which are joined to the other electrode. In that case the electrodes, on the one hand, and partitions at different potentials will be spaced apart. Because the electrodes contact the partitions at a multiplicity of points, electrodes may be used which are comparatively thin-walled but are elastic and which at the conventional operating currents between 1 and 10 kA per $m^2$ of electrode surface area will result only in a low voltage drop of only a few millivolts so that only a small energy loss will be involved in the distribution of the current from the points of contact between the electrodes and the partitions.

The arrangement of the electrodes in accordance with the invention will result in a turbulent upward flow of the evolved gas between the electrode and the diaphragm. As a result, a good equalization of the concentration and temperature in the electrolyte will be achieved, as is equally important for the cell voltage and the long-term durability of the diaphragm.

The spacers are suitably designed to present a low resistance to the upward flow of the mixture of electrolyte and gas bubbles and of the following up electrolyte so that the desirably strong rising turbulent flow will not be adversely affected.

BRIEF DESCRIPTION OF THE DRAWING

The invention is illustrated by way of example in the drawing, which is a fragmentary transverse sectional view showing the design of a bipolar individual cell, which will be explained more in detail hereinafter.

DETAILED DESCRIPTION OF THE INVENTION

The cell 1 is closed on both sides by completely nickel-plated sheet metal partitions 2, 3 which are goffered and have been inserted into an annular frame, not shown. Electrodes consisting of thin plates 8, 9 have been placed on and welded to the humps 4, 5 of the sheet metal partitions 2, 3. Said plates 8, 9 are formed with apertures 6, 7 as passages for the gas which has evolved. The electrodes 8, 9 are separated from each other by the platelike diaphragm 10. Those humps 4, and 5 of the sheet metal partition 2 or 3 which carries one electrode 8 or 9 register with respective apertures 11 or 12, which are formed in the other electrode 9 or 8 and into which a spacer 13 or 14 made of aluminium oxide has been forced so that there is a defined clearance between the diaphragm 10 and the electrodes 8 and 9. Electrodes 15 and 16 which are joined to the sheet metal partitions 2,3 constitute parts of the adjacent cells.

What is claimed is:

1. An electrolyzer comprising individual cells which are geometrically arranged one behind the other and wherein each cell comprises two metallic partitions disposed between the cell and the adjacent cells and have profiled spacing means on both sides, a diaphragm disposed between the portions, and apertured electrodes mounted on both sides of and spaced from the diaphragm to define a space therebetween joined to and in contact with the profiled spacing means disposed on a side of the associated partition which faces the diaphragm, and spacers consisting of a non-metallic, high-melting hard material and firmly joined to the electrodes and disposed in each space between the electrode and the diaphragm, wherein the spacers consist of ceramic oxide materials, including aluminum oxide, nickel oxide and zirconium oxide.

2. An electrolyzer according to claim 1, wherein the space defined by each electrode and the diaphragm has a width of at least 0.3 to 3.0 mm.

3. An electrolyzer comprising individual cells which are geometrically arranged one behind the other and wherein each cell comprises two metallic partitions disposed between the cell and the adjacent cells and have profiled spacing means on both sides, a diaphragm disposed between the portions, and apertured electrodes mounted on both sides of and spaced from the diaphragm to define a space therebetween joined to and in contact with the profiled spacing means disposed on a side of the associated partition which faces the diaphragm, and spacers consisting of a non-metallic, high-melting hard material and firmly joined to the electrodes and disposed in each space between the electrode and the diaphragm, wherein the profiled spacing means has humps which carry the electrodes and each of the spacers which are fixedly joined to each electrode registers with those humps of the profiled spacing means which carry the other electrode.

4. An electrolyzer according to claim 3, wherein the electrodes have a thickness of 0.115 to 0.40 mm and the diaphragm has a thickness of 0.15 to 1.0 mm.

5. An electrolyzer comprising individual cells which are geometrically arranged one behind the other and wherein each cell comprises two metallic partitions disposed between the cell and the adjacent cells and have profiled spacing means on both sides, a diaphragm disposed between the portions, and apertured electrodes mounted on both sides of and spaced from the diaphragm to define a space therebetween joined to and in contact with the profiled spacing means disposed on a side of the associated partition which faces the diaphragm, and spacers consisting of a non-metallic, high-melting hard material and firmly joined to the electrodes and disposed in each space between the electrode and the diaphragm, wherein the diaphragm consists of a thin nickel net as a carrying structure and layers consisting of porous ceramic oxide materials such as nickel oxide, which are sinter-bonded to said net.

6. An electrolyzer according to claim 5, wherein the diaphragm consists of a plastic sheet.

7. An electrolyzer comprising individual cells which are geometrically arranged one behind the other and wherein each cell comprises two metallic partitions disposed between the cell and the adjacent cells and have profiled spacing means on both sides, a diaphragm disposed between the portions, and apertured electrodes mounted on both sides of and spaced from the diaphragm to define a space therebetween joined to and in contact with the profiled spacing means disposed on a side of the associated partition which faces the diaphragm, and spacers consisting of a non-metallic, high-melting hard material and firmly joined to the electrodes and disposed in each space between the electrode and the diaphragm, wherein each electrode comprises a carrier layer of nickel and is provided in the diaphragm side with a skeleton structure made of nickel material including catalyst material consisting of the insoluble component of the Raney alloy, which skeleton structure has been formed by a cold roll cladding of a powder mixture of carbonyl nickel powder and Ranney alloy powder and by sintering and a subsequent catalytic activation.

8. An electrolyzer comprising individual cells which are geometrically arranged one behind the other and wherein each cell comprises two metallic partitions disposed between the cell and the adjacent cells and have profiled spacing means on both sides, a diaphragm disposed between the portions, and apertured electrodes mounted on both sides of and spaced from the diaphragm to define a space therebetween joined to and in contact with the profiled spacing means disposed on a side of the associated partition which faces the diaphragm, and spacers consisting of a non-metallic, high-melting hard material and firmly joined to the electrodes and disposed in each space between the electrode and the diaphragm, wherein the metallic partitions comprise goffered plates, which have humps, which are welded to the electrodes and arranged in register with each other, and the spacers associated with each electrode register with the humps which are joined to the other electrode.

* * * * *